United States Patent [19]

Barnard

[11] 4,005,689

[45] Feb. 1, 1977

[54] FUEL INJECTION SYSTEM CONTROLLING AIR/FUEL RATIO BY INTAKE MANIFOLD GAS SENSOR

[75] Inventor: Daniel Dewey Barnard, Farmington Hills, Mich.

[73] Assignee: The Bendix Corporation, Southfield, Mich.

[22] Filed: Apr. 30, 1975

[21] Appl. No.: 573,509

[52] U.S. Cl. ..... 123/119 A; 60/276; 60/278; 204/195 S; 123/124 R

[51] Int. Cl.[2] ..... F02M 25/00

[58] Field of Search ..... 123/119 A, 141, 124 R; 60/276, 278; 204/1 T, 195 S

[56] References Cited

UNITED STATES PATENTS

| | | | |
|---|---|---|---|
| 3,616,274 | 10/1971 | Eddy | 60/276 |
| 3,759,232 | 9/1973 | Wahl | 123/119 A |
| 3,885,540 | 5/1975 | Stadler | 123/119 A |

*Primary Examiner*—Ronald H. Lazarus
*Attorney, Agent, or Firm*—Russel C. Wells

[57] ABSTRACT

In a fuel injection system for an internal combustion engine, a gas sensor is positioned in the intake manifold and is responsive to a characteristic of the air mixture entering the intake manifold to generate electrical control signals for controlling the injecting of the fuel to the engine. In the preferred embodiment, the air and the recirculated exhaust gas (EGR) are mixed together in a throttle body and the resultant mixture passes by the gas sensor prior to being distributed throughout the manifold system. The output signal of the sensor is used in controlling the injection time of the fuel injectors. Fuel delivery correction delays due to transport lag in conventional closed loop fuel injection systems using oxygen gas sensors placed in the exhaust system are greatly minimized.

3 Claims, 3 Drawing Figures

FUEL INJECTION SYSTEM CONTROLLING AIR/FUEL RATIO BY INTAKE MANIFOLD GAS SENSOR

BACKGROUND OF INVENTION

1. Field of Invention

This invention relates in general to fuel injection systems for internal combustion engines and, in particular, to control systems responding with a gas sensor in the intake manifold to the air mixture containing EGR for controlling the amount of fuel injected into the system.

2. Prior Art

Most fuel management systems can be classified as either an open loop control or a closed loop control system. In the open loop control system, the fuel mixture is preprogrammed and the fuel management system responds only to certain engine operation parameters to alter the fuel mixture. In the closed loop control system, the fuel mixture is also preprogrammed with the fuel management system responding to certain engine operation parameters; however, with the use of an output sensor, the fuel management system is continuously updated to account for fuel management system tolerances, ambient conditions and for particular engine operating conditions so that the actual air/fuel ratio is substantially equal to the desired air/fuel ratio.

Typically most output sensors respond to the characteristics of the fuel mixture and are positioned in the exhaust system of the engine downstream from the point where all the exhaust gases are gathered. This position is generally necessary because most of the sensors are operated at elevated temperatures and the exhaust gases provide the heat source necessary to heat the sensor to its operating temperature. However, this position is a long "time" distance away from the source of the gas mixture and therefore the response time of the system to correct or update the fuel injection is slow. Additionally, the system response time is further altered according to the mode of operation of the engine as indicated by the flow rate of the exhaust gas.

SUMMARY OF THE INVENTION

In the present fuel injection system, EGR is applied to the air entering the manifold thereby reducing the oxygen concentration in the gas mixture in the manifold. By positioning a gas responsive sensor close to the source of the air/EGR mixture, variations in the preprogrammed EGR amount and the air/fuel ratio are detected, the response time is greatly speeded up and in the operation of the fuel injection system the actual air/fuel ratio more closely reflects the desired air/fuel ratio.

In an internal combustion engine a fuel injection system wherein fuel is injected adjacent or into the cylinder, utilizes a mixture control unit receiving both air and recirculated exhaust gas, EGR, and mixes them together. A throttle valve means is located within the mixture control unit for controlling the amount of air being admitted to the engine in accordance with the operator demands. EGR is admitted to the engine through an orifice downstream of the throttle valve and is controlled by an EGR valve. Fuel is supplied from a source such as a fuel storage tank through an electrically controlled injector adjacent or into the cylinder downstream of the mixture control unit.

After the EGR is mixed with the air in the mixture control unit, the resultant mixture is distributed to the several cylinders of the engine by means of an intake manifold. Positioned in the intake manifold immediately downstream of the mixture control unit and responsive to the resultant air/EGR mixture discharging from the mixture control unit is a gas sensor. The sensor generates an electrical signal proportional to the amount of a constituent gas in the air mixture and applies the signal to the fuel injector control means for continuously maintaining the actual air/fuel ratio in accordance with the desied air/fuel ratio and without any significant delay in the response time of the fuel injection system due to the transport time of the fuel mixture or its resultant exhaust mixture to reach a sensing means.

DETAILED DESCRIPTION

Figure 1:
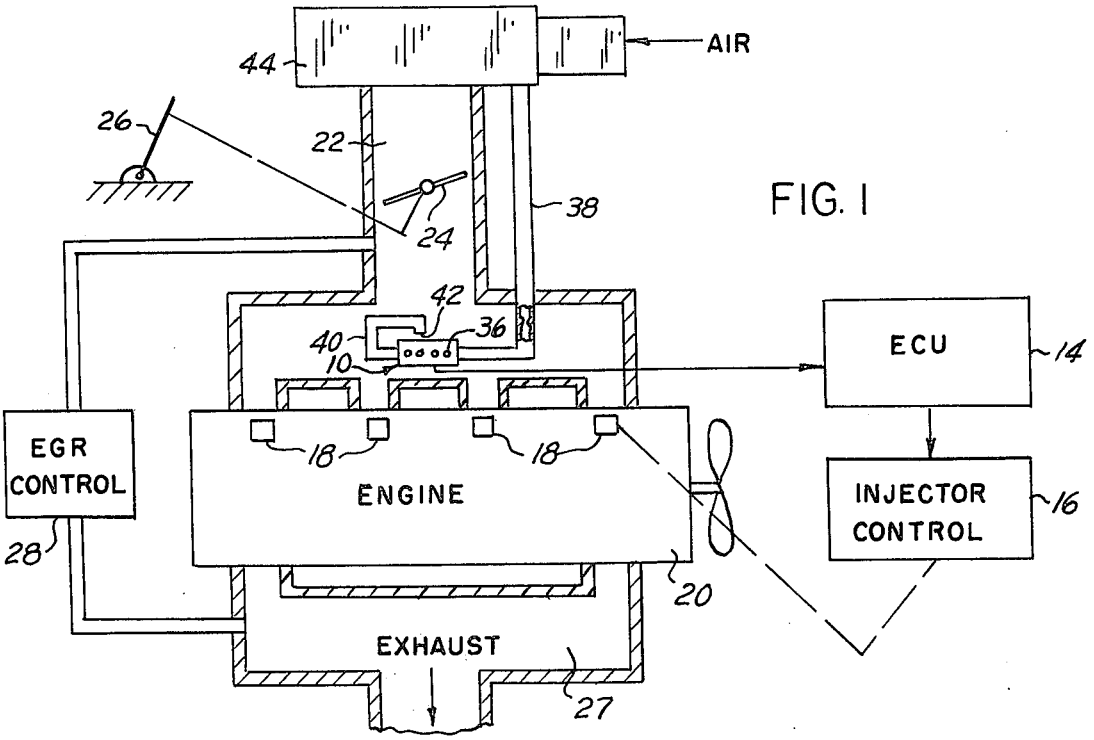
FIG. 1 is a block diagram schematic of the system of the present invention.

Referring to the Figures by the characters of reference there is illustrated in FIG. 1 a block diagram of the system of the present invention. The system is used to afford a precise control of the air/fuel ratio of an internal combustion engine wherein both the air and exhaust gas (EGR) are mixed at a single point such as in a throttle body to form a gas mixture, and the fuel is then mixed with the gas mixture either within the cylinder or adjacent to the intake valve thereof. In the embodiment of FIG. 1, immediately after the air and the exhaust gas are mixed, the oxygen gas concentration is measured by an oxygen gas sensor and the resulting electrical signal which effectively indicates the amount of EGR added to the air is applied to the closed loop control of the injector control. The amount of fuel to be injected is adjusted to maintain the proper combustable mixture in the cylinder for good emissions and fuel economy. This present system avoids prolonged errors in the fuel mixture ratio due to the problem defined as transport lag within a system.

Figure 2:
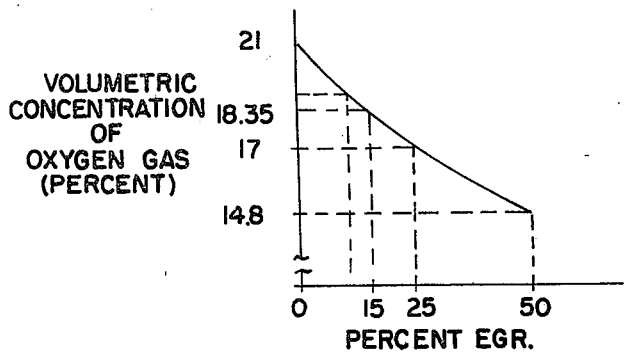
FIG. 2 is a graph of the volumetric oxygen concentration changes in the intake manifold in relationship to the amount of EGR added.

Referring to FIG. 2, there is illustrated a graph of the changes in the volumetric oxygen concentration for changes in the amount of EGR added to the air mixture. Percent EGR along the abscissa of the graph is $$\%EGR = (E/A) \times 100$$

where:

$E$ = the exhaust gas mass in the intake manifold $A$ = the air mass in the intake manifold.

Using a value of 15% EGR, the weight percent of $E$ and $A$ in the intake manifold for 1 unit of mixture mass in the manifold is $$E = 13\% \text{ by weight}$$

$$A = 87\% \text{ by weight.}$$

Extending this calculation under stoichiometric conditions where the typical theoretical reaction is:

$$C_7H_{14} + 10.5\ O_2 + 39.9N_2 \rightarrow 7CO_2 + 7H_2O + 39.9N_2$$

The molecular weight of the combustion products mixture, $E$, is 30.33 and the molecular weight of the air mass, $A$, is 28.96. The moles of $E$ and $A$ are:

$$E = (0.13)/(30.33) = 0.00428$$

$$A = (0.87)/(28.96) = 0.03004$$

The moles of oxygen gas present are:

$$(21\%)(0.03004) = 0.0063;$$

therefore, the % of oxygen gas in the gas mixture at 15% EGR is $$(0.0063)/(0.3432) = 18.35\%.$$

Thus, by the addition of 15% EGR, the amount of oxygen in the gas mixture in the intake manifold is reduced from 21% at 0% EGR to 18.35% at 15% EGR. The graph of FIG. 2 represents the above calculations carried out for values of EGR up to 50%.

Referring to FIG. 1 there is illustrated in block diagrammatic form, a gas sensor 10 positioned in the intake manifold 12 and responsive to the air/EGR mixture flowing thereby. The output of the sensor 10 is supplied to an electronic control unit (ECU) 14, and then to an injector valve driver circuit 16 such as illustrated in the copending patent application Ser. No. 130,349, Junuthula Nirdosh Reddy, "Control Means For Controlling The Energy Provided To The Injector Valves Of An Electronically Controlled Fuel System" as one of the data inputs to influence the injector timing. The injectors 18 meter and measure the flow of fuel adjacent or into the cylinders of the engine 20. The flow of air into the throttle body 22 or mixing means is controlled by a throttle valve 24 actuated through the accelerator means 26 by the operator of the engine 20. The flow of exhaust gas from the exhaust manifold 27 into the throttle body 22 is controlled by an EGR control valve 28. In or immediately downstream of the throttle body the air and the exhaust gas are mixed and discharged into the intake manifold 12.

The throttle body 22 unit in FIG. 1 may take the form of any of the well-known throttle body units used on internal combustion engines. The throttle valve 24 as illustrated in the drawings, represents any similar device which is used to control the flow of air into the intake manifold 12.

Figure 3:
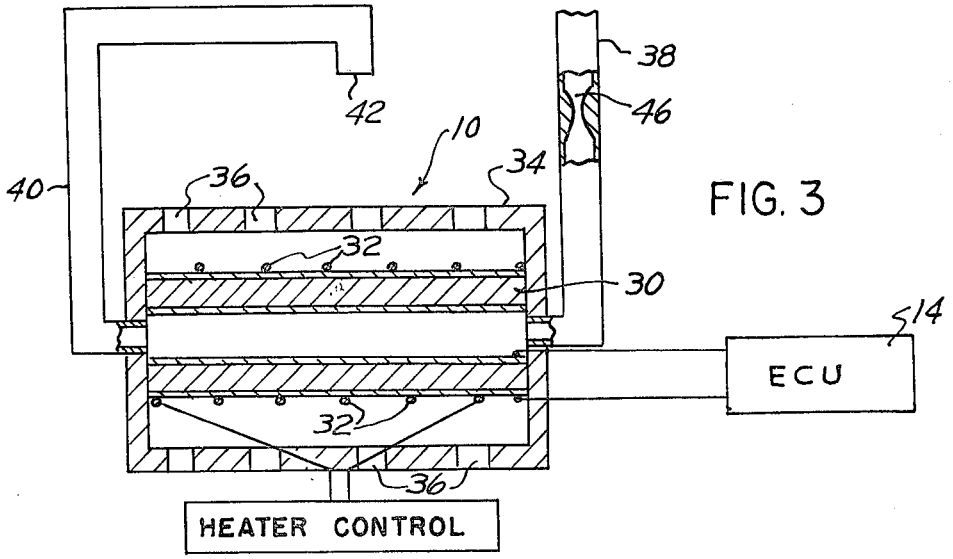
FIG. 3 is an embodiment of the gas sensor unit as may be used in the system of FIG. 1.

As illustrated in FIG. 1, the gas sensor 10 is positioned so as to respond to the air/EGR mixture leaving the throttle body unit 22. The gas sensor 10 as illustrated in FIG. 3 comprises a sensor body 30 in the form of a tube having a heater winding 32 encircling the outside or the inside of the tube. The sensor body 30 is contained within a flame arrester means 34 having a plurality of apertures 36 in the wall of the arrester means 34 allowing the gas mixture to flow to the sensor body 30. Aligned with either end of the sensor body 30 and the arrester means 34 are an inlet and outlet tube 38 and 40 respectively admitting the reference gas which is ambient air into the inside of the sensor body 30 and exhausting it therefrom. The output 42 of the outlet tube 40 is directed so that the reference air is mixed with the gas mixture and is sensed by the sensor 10.

The inlet tube 38 to the sensor 10 may be connected to the air cleaner 44 and due to the vacuum in the intake manifold 12 the air is drawn through the inlet tube 38 through the sensor 10, and into the intake manifold 12. A restrictor 46 is placed in the inlet tube 38 in order to equalize the pressure on the reference side or inside of the sensor body 30 to that of the pressure on the outside or the manifold side of the sensor body. This is necessary because the sensor 10 detects the ratio of the partial pressures of oxygen in the gases on the outside and inside of the sensor body 30 and through electrochemical action is operable to generate a voltage potential.

By discharging the reference gas into the intake manifold 12 the air mixture leaving the throttle body 22 is made richer in oxygen; however, as will hereinafter become apparent by the response of the sensor 10 this added air is compensated.

In the preferred embodiment the sensor body 30 is an oxygen gas sensor fabricated from zirconia. By the use of different stabilizers added to the zirconia different physical and electrical properties can be achieved. The sensor 10 is a reference-type sensor where its output electrical signal is a function of the difference in oxygen concentration that exists from one side of the sensor to the other. As previously indicated the pressures on both sides of the sensor body 30, inside and outside, are maintained substantially equal. Using ambient air as the reference gas and the gas mixture, comprising ambient air and EGR, as the sample mixture, the electrical voltage output of the cell follows the Nernst equation as the concentration of oxygen gas on the sample side is reduced due to added EGR.

It is necessary that the oxygen gas sensor be heated to an elevated temperature in order to overcome the internal impedance of the material. At low temperatures on the order of 70° F, the internal impedance is so great that electrically the sensor approximates an open circuit. However, at approximately 700° F, the internal impedance drops from the 100 megohms, open circuit, to approximately 2,000 ohms. This temperature of 700° F is normally not found in the intake manifold system and therefore an electrically powered heater 32 is wound around the zirconium tube. This heater 32 will locally raise the temperature of the sensor body 30 to the proper operating temperature allowing the sensor 10 to function. Since this added heat may cause the gas around the sensor to burn, the flame arrester means 34 is provided to contain and prevent any propagation of the flame throughout the intake manifold 12.

Also as previously indicated, the reference gas for the oxygen sensor is supplied from the ambient air surrounding the engine 20 through the air cleaner 44 and piped by means of an inlet tube 38 into the manifold 12 and to the sensor body 30. Since the response of the sensor body 30 is a function of the change in the oxygen partial pressure ratio across the sensor, it is desirable that the total pressures be equalized or nearly equalized. This is accomplished by providing the restrictor 46 in the inlet tube 38.

The effectiveness of the restrictor 46 depends on the rate of air flow through the restrictor and the size of the restrictor. The rate of idle air flow at idle for small engines, 140 cu. in, displacement is approximately 30 lbs./hr. The pressure downstream of the restrictor 46 is approximately 7 psia and the pressure upstream of the restrictor is ambient or approximately 15 psia; therefore the ratio of the downstream to the upstream pressure is 7/15 or 0.46. This gives a restrictor diameter size under sonic air flow conditions of approximately 0.04 in. which, although small, is not too dirt sensitive. Therefore, with such a restrictor 46 in the inlet tube 38, the pressure of the reference gas and the pressure of the sample gas or air mixture in the intake manifold are approximately equal.

The electrical signal generated by the sensor 10 is electrically conducted by a pair of wires one of which is connected to the inside surface and the other is connected to the outside surface of the sensor body 30 to the ECU 14 as indicated in FIG. 3. However, one side of the sensor may be grounded to the same ground as the ECU 14 and therefore only one wire would be required.

With the sensor 10 being positioned substantially at the output of the throttle body 22 and in the intake manifold 12, the problems in correcting the air/fuel ratio of the fuel mixture supplied to the engine due to transport lag have been greatly minimized. Immediately after the air and exhaust gas are brought together for mixing the makeup, in particular, the oxygen content of the gas mixture is sensed and the flow of fuel is metered.

There has thus been shown and described a system for maintaining a desired air/fuel ratio in a fuel injected internal combustion engine by measuring the air mixture entering the intake manifold by means of a gas sensor immediately after the mixture is formed and using the electrical intelligence generated by said measurement corresponding to the amount of oxygen present in the air mixture, the fuel being supplied to the injectors is controlled.

I claim:

1. In a fuel injection system, a system for controlling the air/fuel ratio in response to an amount of a constituent gas content of the mixture in the intake manifold of the engine comprising:

an internal combustion engine including;

a plurality of cylinders, air intake means for receiving and controlling ambient air for combustion, exhaust gas recirculation means connected to said air intake means for supplying an amount of exhaust gas to the ambient air in said air intake means forming a gas mixture, and intake manifold means for distributing said gas mixture to said cylinders said intake manifold means connected to said air intake means downstream of said exhaust gas recirculation means connection;

fuel injector means;

means for supplying the fuel to said fuel injector means;

a gas sensor means positioned in said intake manifold means and adjacent said air intake means and comprising means for supplying ambient air to one surface thereof, said gas sensor means responsive to all of the flow to another surface thereof of the gas mixture for generating an electrical signal proportional to the difference in the amount of the sensed constituent gas in said gas mixture flowing into the intake manifold means and the amount of the sensed constituent gas in the ambient air, and control means responsive to said electrical signal for controlling the operation of said fuel injector means thereby controlling the operation of said fuel injector means in accordance with the amount of said sensed constituent gas in said gas mixture in the intake manifold means.

2. In the system for controlling the air/fuel ratio according to claim 1 wherein said gas sensor is an oxygen gas sensor and comprises:

a tubular zirconia body having a pair of electrical conductors and respectively connected to the inside surface and the outside surface of said body, said body operable to electrochemically generate an electrical signal in response to the ratio of the partial pressure of oxygen gas in said gas mixture surrounding said outside surface and a reference gas surrounding said inside surface;

first and second conduit means connected respectively to each end of said tubular body said first conduit means for receiving ambient air for use as said reference gas and conducting said air to the inside surface of said body and said second conduit means for exhausting the air from the inside surface of said body and into said gas mixture;

means for heating said body;

flame arrestor means spaced from and enclosing said body and having a plurality of apertures therein in a spaced relation for allowing the flow of said mixture gas to impinge on the outside surface of said body, and mounting means for mounting said gas sensor in said intake manifold.

3. In a fuel injection system a system controlling the amount of fuel in response to the amount of EGR in air mixture, said system comprising:

an internal combustion engine having intake manifold means and fuel injection means for supplying fuel to the cylinders;

exhaust gas recirculation means for supplying a quantity of exhaust gas;

air intake means for receiving ambient air substantially free of exhaust gas;

mixing means for receiving the exhaust gas from said exhaust gas recirculation means and the ambient air from said air intake means for combining into a gas mixture, sad mixing means having an output and a throttle valve member responsive to the engine operator;

intake manifold means connected to said output of said mixing means for receiving said gas mixture and distributing said gas mixture to said cylinders, oxygen gas sensor means mounted in said intake manifold means and having means for supplying ambient air to one surface thereof and said sensor means responsive to all of said gas mixture flowing to another surface thereof for generating an electrical signal proportional to the difference between the oxygen concentration of said mixture and said ambient air, and control means responsive to said electrical signal and operative for controlling the amount of fuel discharged into the cylinders by the injectors to maintain a desired fuel/air ratio.

* * * * *